US012735149B2

(12) United States Patent
Tardif et al.

(10) Patent No.: US 12,735,149 B2
(45) Date of Patent: Sep. 15, 2026

(54) FOLDABLE RECLINER DEVICE FOR BOAT DECK

(71) Applicants: Jean-Marc Tardif, Sherbrooke (CA); Maxime Cinq-Mars, Drummondville (CA)

(72) Inventors: Jean-Marc Tardif, Sherbrooke (CA); Maxime Cinq-Mars, Drummondville (CA)

(73) Assignee: E-Z Tech Marine Inc., Sherbrooke (CA)

( * ) Notice: Subject to any disclaimer, the term of this patent is extended or adjusted under 35 U.S.C. 154(b) by 229 days.

(21) Appl. No.: 18/792,662

(22) Filed: Aug. 2, 2024

(65) Prior Publication Data

US 2025/0042516 A1 Feb. 6, 2025

Related U.S. Application Data

(60) Provisional application No. 63/530,506, filed on Aug. 3, 2023.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS 5,320,060 A * 6/1994 Gunter ..... B63B 34/20 297/195.11
6,605,023 B1 * 8/2003 Mobley ..... A63B 21/4029 482/142
9,249,827 B2 * 2/2016 Serocki ..... B60N 2/24
11,999,445 B1 * 6/2024 Farrell ..... B63B 29/04

FOREIGN PATENT DOCUMENTS

EP 3988445 A1 * 4/2022 ..... B63H 20/08

* cited by examiner

*Primary Examiner* — Justin M Benedik
(74) *Attorney, Agent, or Firm* — PRAXIS

(57) ABSTRACT

A foldable recliner device for a boat deck has a seat section releasably securable to the boat deck and a back section hingeably mounted on the seat section, between a folded configuration with the back section generally folded against the seat section and an open configuration with the back section extending from the seat section and forming an angle therebetween larger than zero degree (0°) and up to one hundred and eighty degrees (180°). The back section includes a backrest portion, an arch portion, and a retainer portion. The backrest portion and the retainer portion are hingeably mounted on the seat section and are independently movable relative to one another. The arch portion is hingeably mounted on the backrest portion and removably connects to the retainer portion when in the open configuration.

11 Claims, 5 Drawing Sheets

FOLDABLE RECLINER DEVICE FOR BOAT DECK

CROSS-REFERENCE TO RELATED APPLICATIONS

The present application claims the benefit of U.S. provisional patent application No. 63/530,506, filed on Aug. 3, 2023.

TECHNICAL FIELD OF THE INVENTION

The present invention relates to chairs, especially for use on boat decks, and more specifically to a foldable recliner device that generally non-invasively mounts on a boat deck surface, such as the so-called recreational boats.

BACKGROUND OF THE INVENTION

There exists, nowadays, many types of recliners mounted on boat sun decks, but these recliners are always designed for the specific boat and are invasively (permanently) secured to the deck via screws or the like attachments or via other structure of the boat. Usually, these recliners are factory installed when ordering your boat. Some manufacturers allow orders and custom manufactures to retrofit such recliners, but they are always permanently secured to the boat. Only the covering mattress or sunpad is removable when not in used, such as overnight, during storms, or simply for storage.

When the boat owner sells off his/her boat to buy a new one for example, new recliners have to be ordered for the new boat for example.

Some of these existing recliners are simply backrests with hinge mounts directly secured to the boat deck. Alternatively, some recliners are in the form of a reclining support directly mounted on the rigid back side of a sun mattress specifically made for the shaped deck of the boat.

All the above makes the recliners quite expensive, and not affordable to everyone.

Essentially, no recliners are available on the market as an aftermarket add-on. If a boat doesn't have a recliner design for it, the boat owner simply cannot get one.

Accordingly, there is a need for an improved foldable recliner device for use on a boat deck.

SUMMARY OF THE INVENTION

It is therefore a general object of the present disclosure to provide a foldable recliner device for use on a boat deck that obviates the above-noted drawbacks and problems.

An advantage of the present invention is that the recliner device is non-invasively secured to the boat deck, such that it is entirely removable therefrom without any permanent damage on the deck surface, and if desired, re-installed on another location or boat.

Another advantage of the present invention is that the recliner device can be sold, with or without the sunpad, at any store and installed on almost any boat deck surface (as long as the deck surface is locally generally flat and large enough) of any water craft, such as a recreational (or pleasure or leisure) boat or the like.

A further advantage of the present invention is that the recliner device may include a sunpad that (via hoop-and-loop fastener (Velcro™), straps, braids, rubber pads, snap fasteners, etc.) can be removably secured to at least one of the seat and the back sections of the foldable recliner.

Yet another advantage of the present invention is that the recliner device can have the back section reclined away from the seat section (as a lounge chair), or towards the seat section to be oriented in the opposite direction. This latter configuration also allows for the device to be used in an opposite direction when there is limited space on the boat deck.

Another advantage of the present invention is that the recliner device can be manufactured with typical materials that are compatible with water activities and the like.

Still another advantage of the present invention is that the recliner device can be easily installed on a slopped or rounded deck surface of a boat using simple shim(s) or the like parts that could, for example, be made out of left over or removed material during the manufacturing of the recliner.

A further advantage of the present invention is that the recliner device is typically made out of relatively light material and also folds on itself to make it is easy to carry. Accordingly, the recliner device could also fit within travel luggage to be carried while travelling by plane or other transportation system.

According to an aspect of the present invention there is provided a foldable recliner device for a boat deck, the foldable recliner device comprising:

- a seat section for releasably securing to the boat deck; and
- a back section hingeably mounting on the seat section about a main axis between a folded configuration with the back section generally folded against (resting on, 0° angle) the seat section and an open configuration with the back section extending from the seat section and forming an angle therebetween larger than zero degree (0°) and up to one hundred and eighty degrees (180°), the back section including a backrest portion, an arch (adjuster, support arm) portion, and a retainer (support plate) portion, the backrest portion and the retainer portion hingeably mounting on the seat section and being independently movable relative to one another, the arch portion being hingeably mounting on the backrest portion and removably connecting to the retainer portion when in the open configuration.

In one embodiment, the arch portion includes a proximal end hingeably mounting on the backrest portion and a distal end removably connecting to the retainer portion via a connector member.

Conveniently, the connector member includes a protrusion located at the distal end and extending away from the proximal end, and at least one notch (opening) extending into the retainer portion and being selectively removably engaged by the protrusion when in the open configuration.

Conveniently, the protrusion and the at least one notch are elongated in a direction generally parallel to the (hinge) main axis.

In one embodiment, the backrest portion includes side bars extending along back lateral sides thereof in a direction generally perpendicular to the (hinge) main axis.

Conveniently, the side bars protrude along seat lateral sides of the seat section when in the folded configuration.

In one embodiment, at least the seat section has a plurality of openings extending therethrough.

In one embodiment, the device further comprises an attachment member mounting on the seat section for releasably securing the foldable recliner device to the boat deck.

Conveniently, the attachment member is a hoop-and-loop fastener.

In one embodiment, the device further comprises a cover pad covering at least one of the seat and back sections when in the open configuration.

Conveniently, the cover pad is removably secured to the at least one of the seat and back sections.

Other objects and advantages of the present invention will become apparent from a careful reading of the detailed description provided herein, with appropriate reference to the accompanying drawings.

BRIEF DESCRIPTION OF THE DRAWINGS

Embodiments of the disclosure will be described by way of examples only with reference to the accompanying Figures, with similar references referring to similar components, in which.

DETAILED DESCRIPTION OF THE INVENTION

Figure 1:
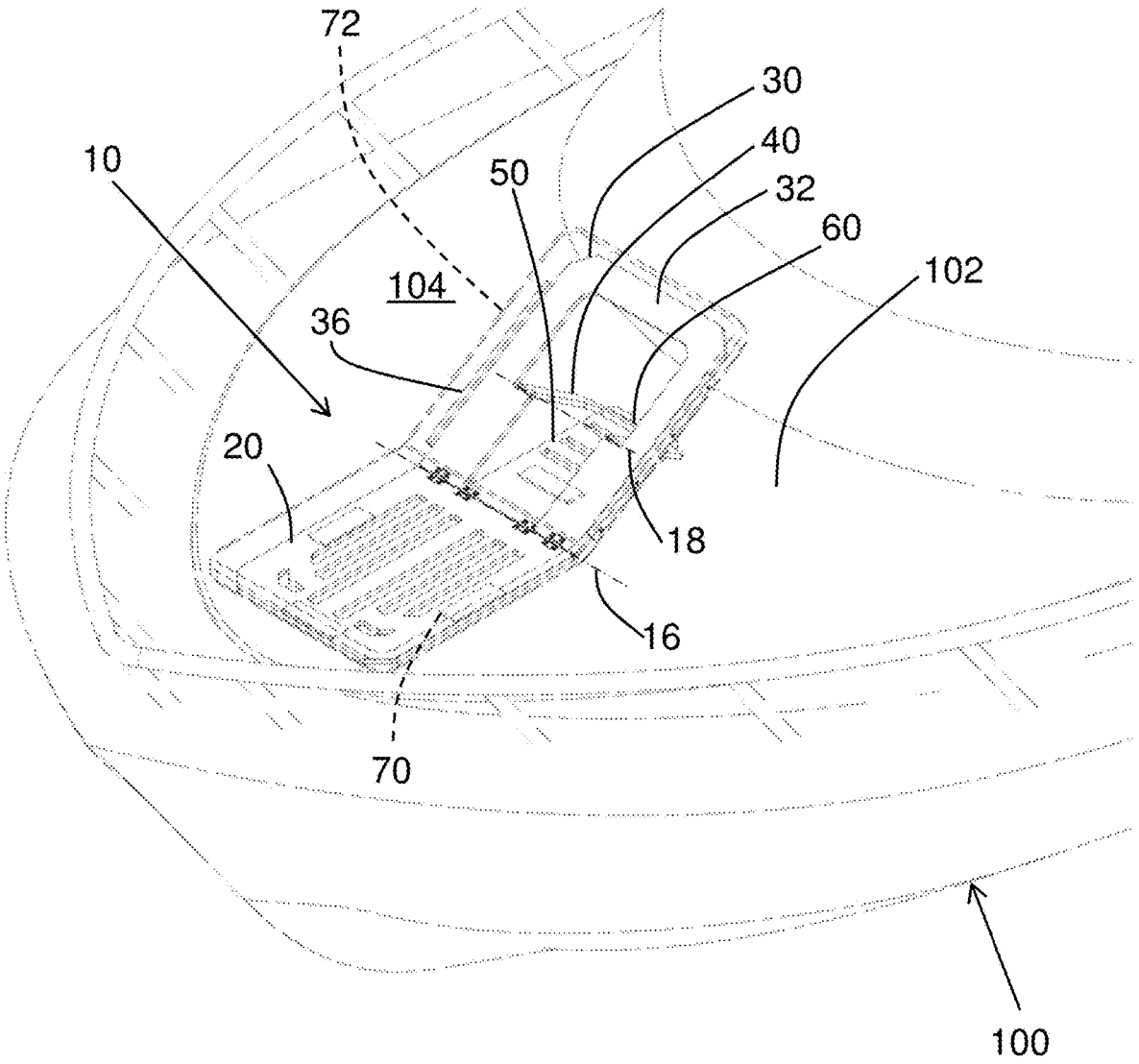
FIG. 1 is a schematic top perspective view of a foldable recliner device in accordance with an embodiment of the present invention, showing the foldable recliner device installed on the top surface of a boat deck and covered by a sunpad.
Figure 2:
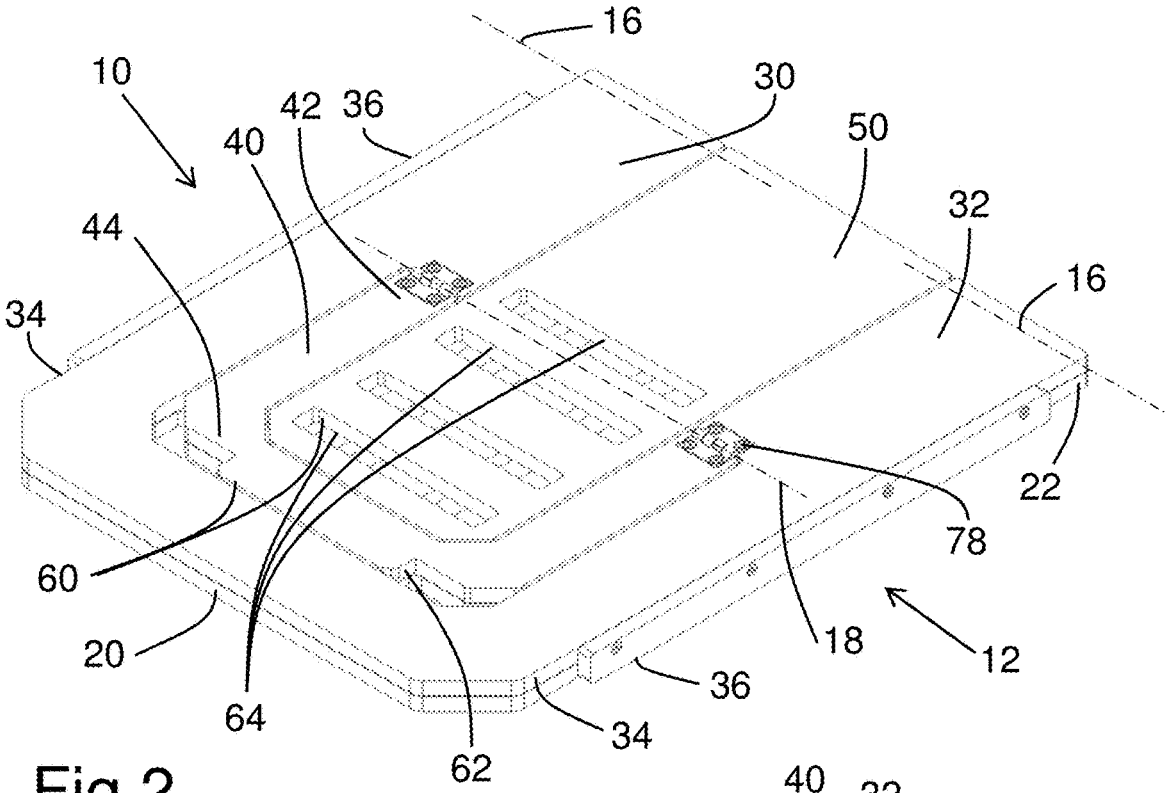
FIG. 2 is an enlarged schematic top perspective view of the foldable recliner device of FIG. 1 shown in the folded configuration (0 degree)
Figure 3:
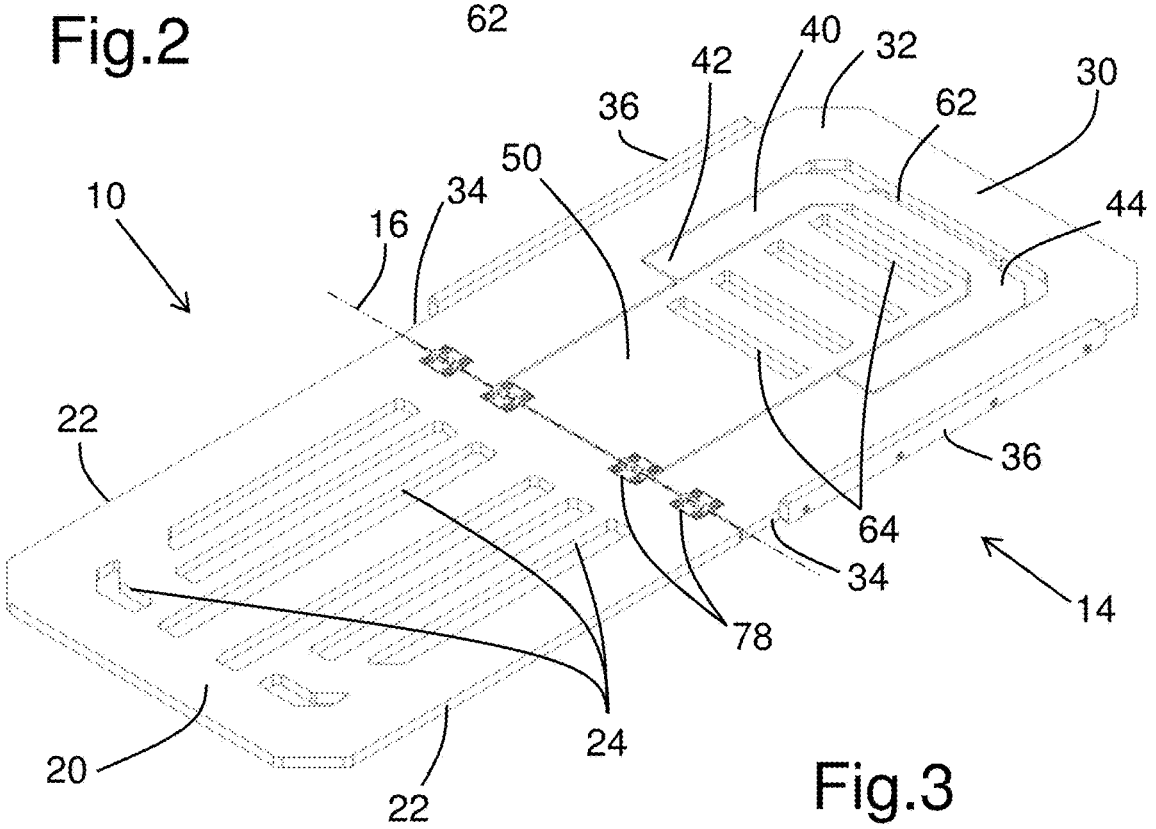
FIG. 3 is an enlarged schematic top perspective view of the foldable recliner device of FIG. 1 shown in the open configuration at 180 degrees.

Referring to FIGS. 1 to 8, there is shown an embodiment of a foldable recliner device 10 in accordance with the present invention, for a surface 104 of a deck 102 of a watercraft 100, such as a recreational boat (schematically shown in stippled lines in FIG. 1, and partially broken) or the like. The device 10 typically includes a seat section 20 (or seat plate) for releasably securing to the boat deck 102; and a back section 30 (or back plate) hingeably mounting on the seat section 20, about a main axis 16, between a folded configuration 12 (shown in FIG. 2) with the back section 30 generally folded against the seat section 20 (or the back section 30 resting on the seat section 20, at a 0° angle therebetween), and an open configuration 14 (shown in FIG. 3, and also 4-8) with the back section 30 extending from the seat section 20 and forming an angle therebetween larger than zero degree (0°) and up to one hundred and eighty degrees (180°).

In the embodiment 10 illustrated in the figures, the back section 30 typically includes a backrest portion 32, an arch (or adjuster, support arm) portion 40, and a retainer (or support plate) portion 50. The backrest portion 32 and the retainer portion 50 are typically hingeably mounted on the seat section 20, about the hinge main axis 16, and are independently movable relative to one another. The arch portion 40 is typically hingeably mounted on the backrest portion 32, about a secondary axis 18, and removably connects to the retainer portion 50 when in the open configuration 14. The retainer portion 50 typically remains at the 180° angle relative to the seat section 20 when in the open configuration 14, while the backrest 32 and arch 40 portions are at different angles depending on the selected position.

In the present embodiment 10, the arch portion 40 includes a proximal end 42 hingeably mounting on the backrest portion 32 (via the secondary axis 18) and a distal end 44 that is selectively removably connectable to the retainer portion 50 via a connector member 60.

Typically, the connector member 60 includes a protrusion 62 located at the distal end 44 of the arch portion 40 and extending away from the proximal end 42, and at least one notch 64 (opening) extending, preferably through, into the retainer portion 50 and which is selectively removably engaged by the protrusion 62 when in the open configuration 14.

Figure 4:
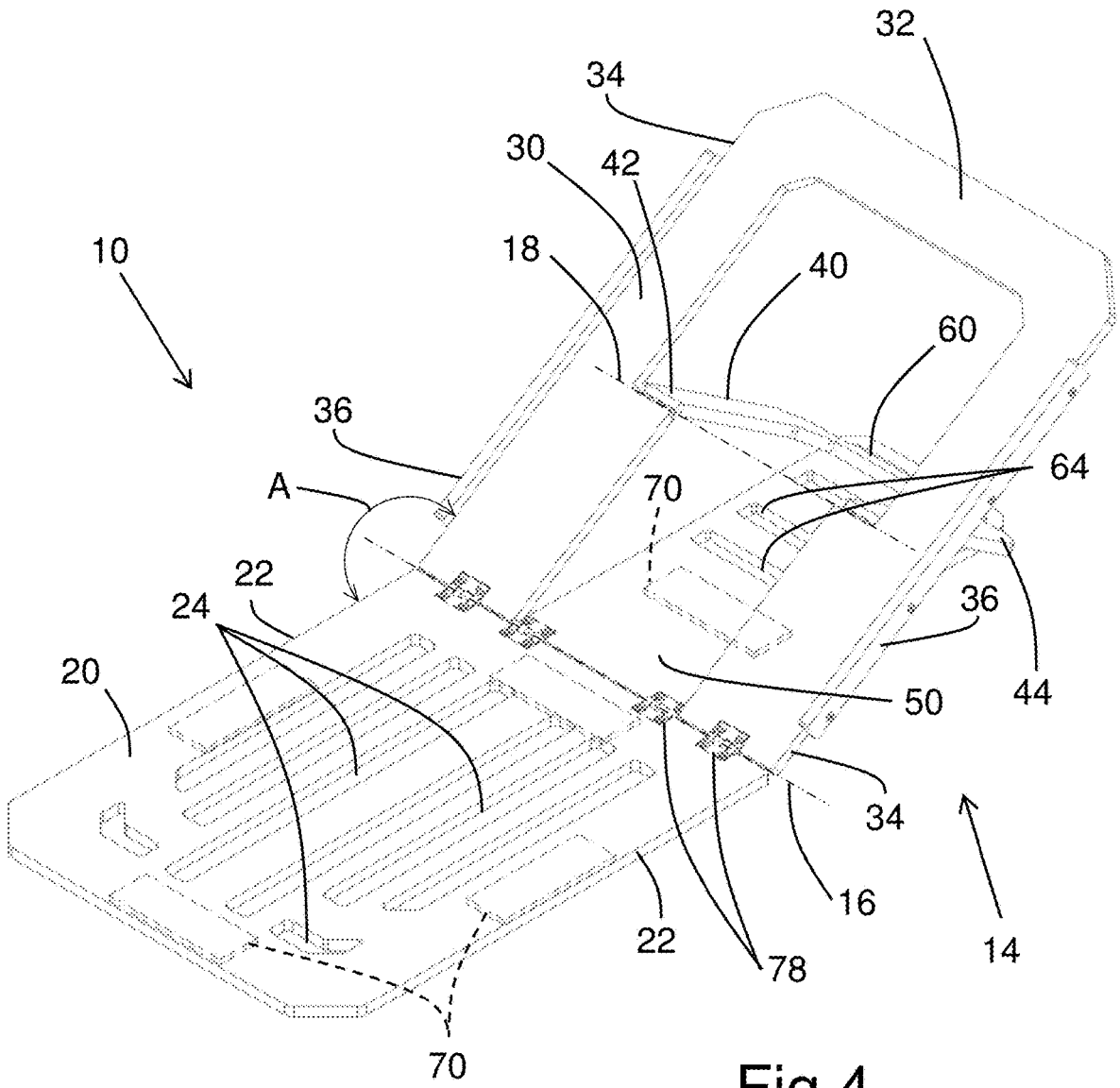
FIG. 4 is an enlarged schematic top perspective view of the foldable recliner device of FIG. 1 shown in the open configuration at the lowest angled position of the backrest portion (about 150 degrees)
Figure 5:
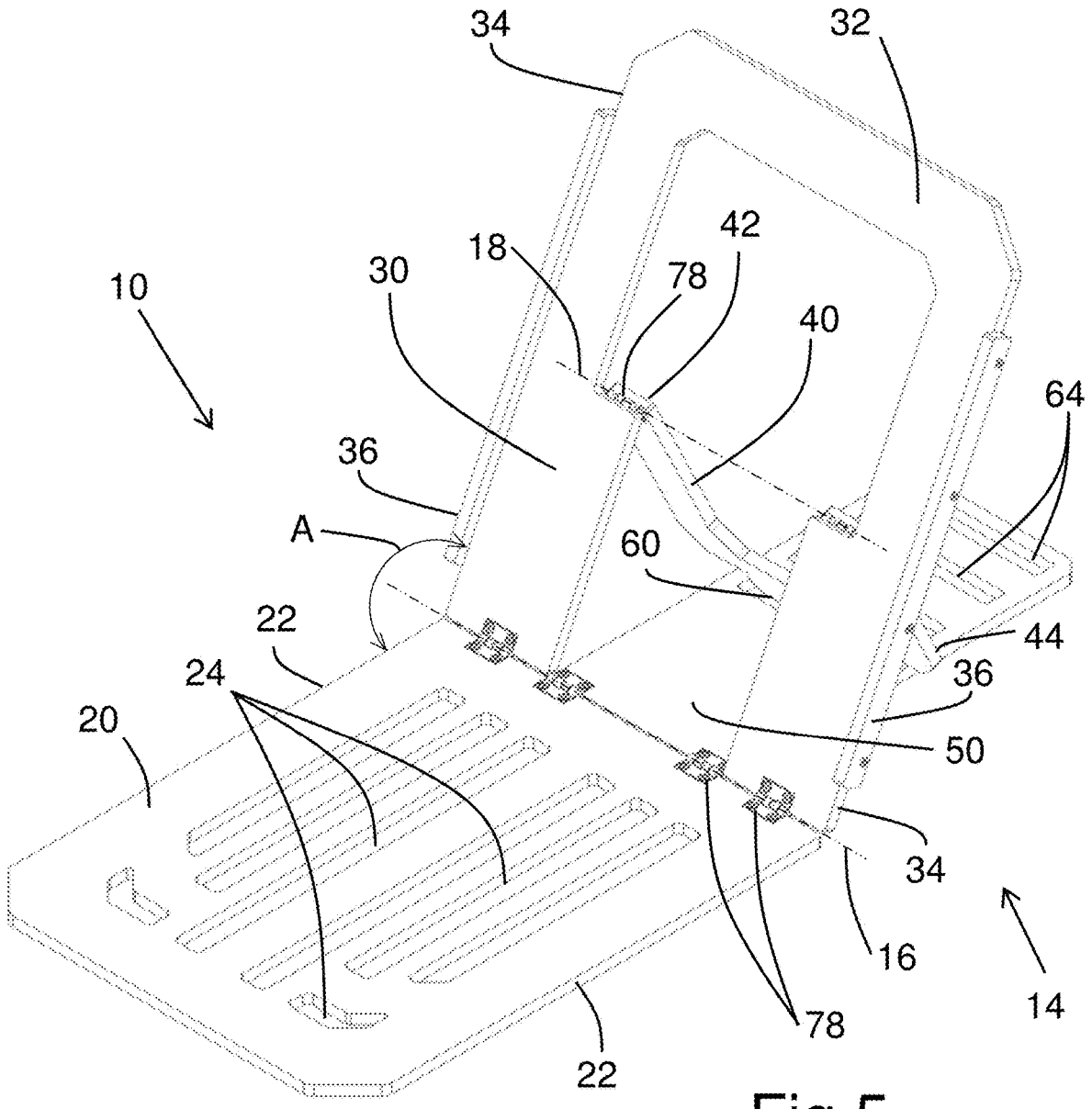
FIG. 5 is an enlarged schematic top perspective view of the foldable recliner device of FIG. 1 shown in the open configuration at the highest angled position of the backrest portion (about 120 degrees)
Figure 6:
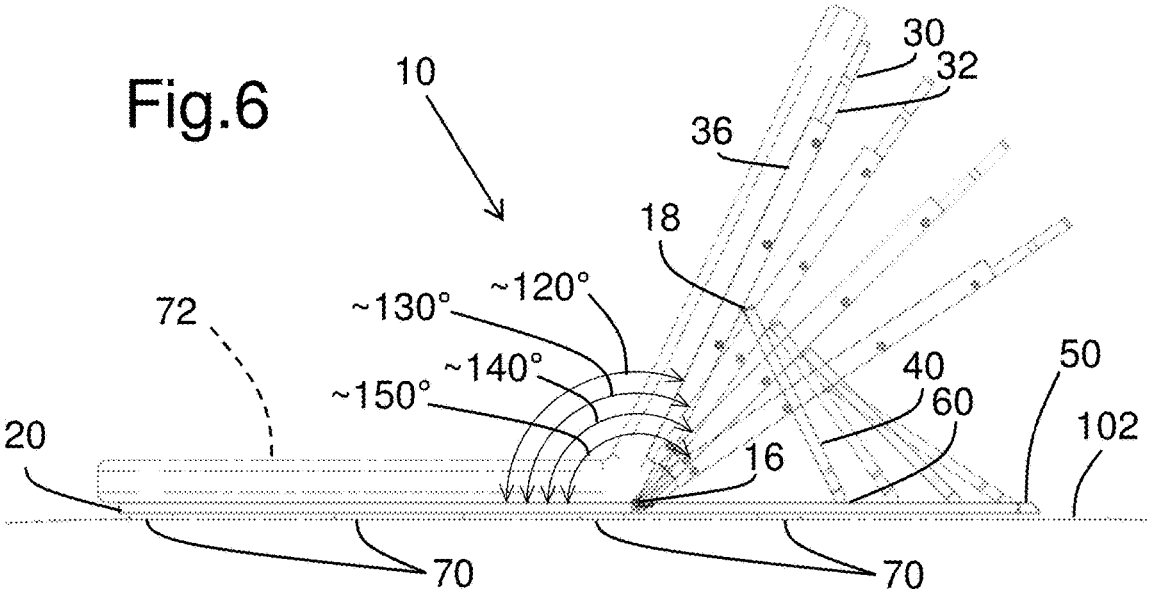
FIG. 6 is an enlarged schematic side elevation view of the foldable recliner device of FIG. 1 shown in the open configuration at the highest angled position of the backrest portion (about 120 degrees) in solid lines, at lowest angled position of the backrest portion (about 150 degrees) in dashed lines, and at two intermediate angled positions of the backrest portion (about 130 & 140 degrees) also in dashed lines.

Typically, the connector member 60 allows to recline the backrest portion 32 in different discrete positions corresponding to different angles A relative to the seat section 20. This is allowed by the plurality of notches 64 extending into the retainer portion 50. Other than the zero-degree (0°) and one hundred and eighty degrees (180°) illustrated in FIGS. 2 and 3, respectively, an about one hundred and fifty degree angle (150°) position is illustrated in FIG. 4 and an about one hundred and twenty degree angle (120°) position is illustrated in FIG. 5. That 120° is also illustrated in solid lines in FIG. 6, while the 150° angle position and two intermediate positions at angles of about 130° and 140° are shown in stippled lines. It is noted that the width (in a direction generally perpendicular to the main axis 16) of the different notches 64 slightly varies from one another to account for the angle of the protrusion 62 selectively engaging them.

Typically, the protrusion 62 and the plurality of notches 64 are elongated in a direction generally parallel to the hinge main axis 16, as well illustrated in the figures.

In order to releasably secure the device 10 to the boat deck 102 and thereby prevent any undesired displacement thereof relative to the beck surface 104, the device 10 typically includes an attachment member 70, generally shown in stippled lines as being hidden, mounting on the seat section 20, facing the deck surface 104. The attachment member 70 is preferably a hoop-and-loop fastener, as shown at different locations in stippled lines in FIGS. 1, 4 and 6-8, although it would be obvious to one skilled in the art that other types of attachment members could be used without departing from the scope of the present invention, as long as they remain non-invasive to the boat deck 102. An additional piece of hoop-and-loop fastener 70 is also typically used to between the deck surface 104 and the retainer portion 50 when in the open configuration 14, as illustrated in FIGS. 1 and 4.

Typically, the device 10 includes a cover pad 72 (mattress or foam typically used with water-related activities), shown in stippled lines for clarity purposes, to cover at least one of, and preferably both the seat 20 and the back 30 sections when in the open configuration 14, as shown in stippled lines in FIGS. 1 and 6-8. The cover pad 72 adds comfort to the device 10 for users.

Although not specifically illustrated, the cover pad 72 is typically removably secured to either one or both the seat 20 and the back 30 sections, via any suitable and well-known securing member (including but not limited to hoop-and-loop fastener, straps, braids, rubber pads, snap fasteners, and the like), especially to retain it in place under windy conditions or the like, when no user lays thereon.

To help rigidify the backrest portion 32, reinforcing side bars 36 typically extend along back lateral sides 34 thereof, in a direction generally perpendicular to the hinge main axis 16 between the seat 20 and back 30 sections. And to further help in retaining the cover pad 72 in position on the backrest portion 32 when in the open configuration 14 as well as properly aligning the back section 30 to the seat section 20 when in the folded configuration 12, the side bars 36 typically slightly protrude in a direction generally perpendicular to the main axis 16 towards the seat section 20 (to extend along seat lateral sides 22 of the seat section 20 when in the folded configuration 14).

Typically, as illustrated in the figures, at least the seat section 20 has a plurality of openings 24 extending therethrough. These openings 24, in addition to provides some weight relief to the device 10, allow for the water to flow, and evaporate, more easily between the device 10 and the underlying deck surface 104, so a to prevent the accumulation of moisture, fungus and the like. In order to save on the materials, the sides bars 36 could typically come from the material removed from the openings 24.

Although conventional hinges 78 are illustrated between the parts that hingeably mount relative to each other, it would be obvious to one skilled in the art that any other types of hinge members could be used without departing from the scope of the present invention.

Figure 7:
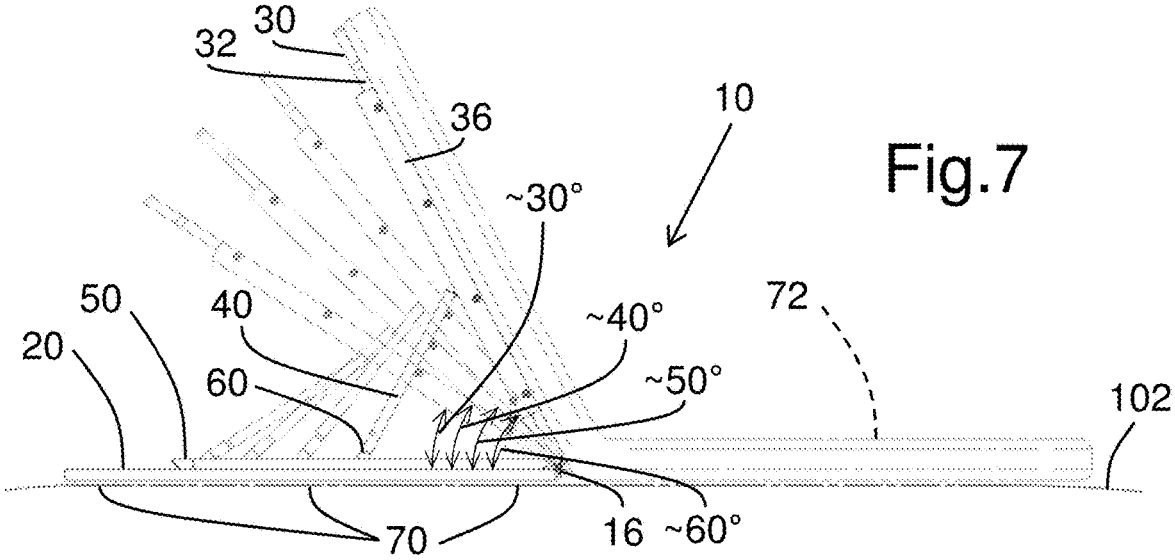
FIG. 7 is an enlarged schematic side elevation view similar to FIG. 6, shown in the open configuration but in the opposite direction, at the highest angled position of the backrest portion (about 60 degrees) in solid lines, at lowest angled position of the backrest portion (about 30 degrees) in dashed lines, and at two intermediate angled positions of the backrest portion (about 40 & 50 degrees) also in dashed lines, in order to use the foldable recliner device with the sunpad oriented in the opposite direction and resting against the opposite side of the backrest portion.

As illustrated in FIG. 7, the device 10, once releasably secured to the boat deck 102, could also be used in the opposite direction by having the back section 30 angled relative to the seat section with angles being more than 0° and less than 90°, with the retainer portion 50 essentially resting on the seat section 30 (with the backrest portion 32 at about 60° from the seat section 20 in solid lines, and at about 50°, 40°, and 30° from the seat section 20 in stippled lines, respectively). In this alternate open configuration 14', the cover pad will be typically partially directly resting on the deck surface 104 and partially cover the backrest portion 50. It is to be noted that if the device 10 is to also be used in the alternate open configuration 14', either the conventional hinges 78 need to be properly relocated or other type of hinge members (such as, but not limited to, double-sided (or double swing) hinges, flexible members, etc.) should be considered (to accommodate for both open configurations 14, 14').

Figure 8:
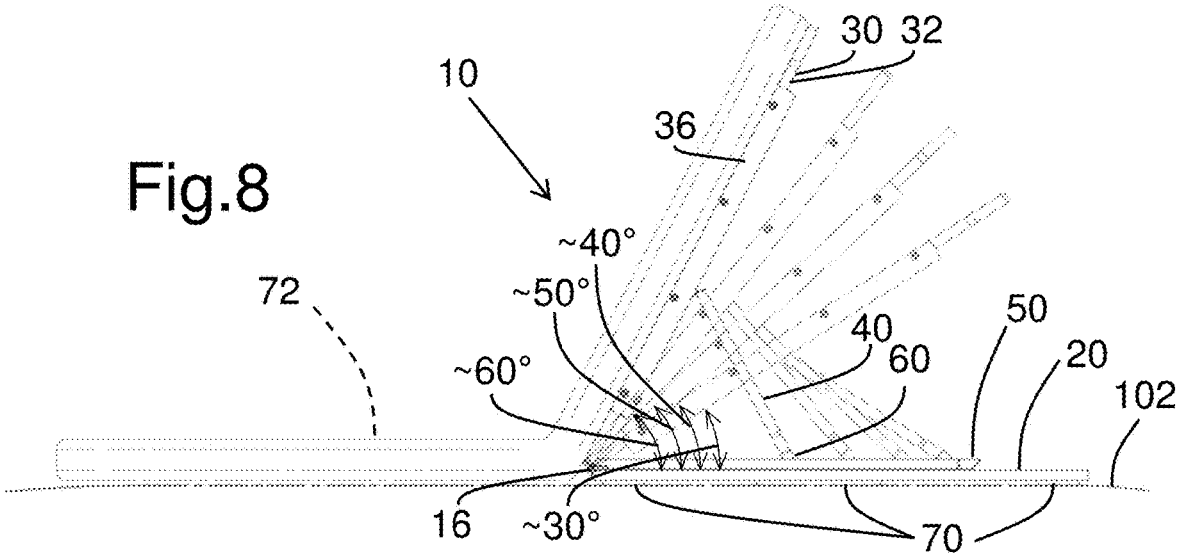
FIG. 8 is an enlarged schematic side elevation view similar to FIG. 7, but with the foldable recliner device installed in the opposite direction on the boat deck.

If the boat deck 102 is not well suited to receive the device 10 thereon as illustrated in FIGS. 1-7, it could alternatively be releasably secured to the boat deck 102 in the opposite orientation and be used in a similar manner shown in FIG. 7, as illustrated in FIG. 8.

Although the present disclosure has been described with a certain degree of particularity and by way of an illustrative embodiment and examples thereof, it is to be understood that the present disclosure is not limited to the features of the embodiments described and illustrated herein, but includes all variations and modifications within the scope and spirit of the disclosure as hereinafter claimed.

The invention claimed is:

1. A foldable recliner device for a boat deck, the foldable recliner device comprising:

a seat section for releasably securing to the boat deck; and a back section hingeably mounted on the seat section about a main axis between a folded configuration with the back section generally folded against the seat section and an open configuration with the back section extending from the seat section and forming an angle therebetween larger than zero degree (0°) and up to one hundred and eighty degrees (180°), the back section including a backrest portion, an arch portion, and a retainer portion, the backrest portion and the retainer portion hingeably mounted on the seat section and being independently movable relative to one another, the arch portion being hingeably mounted on the backrest portion and removably connecting to the retainer portion when in the open configuration.

2. The device of claim 1, wherein the arch portion includes a proximal end hingeably mounted on the backrest portion and a distal end removably connecting to the retainer portion via a connector member.

3. The device of claim 2, wherein the connector member includes a protrusion located at the distal end and extending away from the proximal end, and at least one notch extending into the retainer portion and being selectively removably engaged by the protrusion when in the open configuration.

4. The device of claim 3, wherein the protrusion and the at least one notch are elongated in a direction generally parallel to the main axis.

5. The device of claim 1, wherein the backrest portion includes side bars extending along back lateral sides thereof in a direction generally perpendicular to the main axis.

6. The device of claim 5, wherein the side bars protrude along seat lateral sides of the seat section when in the folded configuration.

7. The device of claim 1, wherein at least the seat section has a plurality of openings extending therethrough.

8. The device of claim 1, further comprising an attachment member mounted on the seat section for releasably securing the foldable recliner device to the boat deck.

9. The device of claim 8, wherein the attachment member is a hook-and-loop fastener.

10. The device of claim 1, further comprising a cover pad covering at least one of the seat and back sections when in the open configuration.

11. The device of claim 10, wherein the cover pad is removably secured to the at least one of the seat and back sections.

* * * * *